US007495395B2

(12) United States Patent
Choi et al.

(10) Patent No.: US 7,495,395 B2
(45) **Date of Patent: *Feb. 24, 2009**

(54) PLASMA DISPLAY PANEL WITH DEFINED PHOSPHOR LAYER THICKNESSES

(75) Inventors: Seo-Young Choi, Suwon-si (KR); Seung-Beom Seo, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/607,470

(22) Filed: Dec. 1, 2006

(65) Prior Publication Data

US 2007/0159101 A1 Jul. 12, 2007

Related U.S. Application Data

(63) Continuation of application No. 10/996,581, filed on Nov. 22, 2004, now Pat. No. 7,164,231.

(30) Foreign Application Priority Data

Nov. 24, 2003 (KR) ..... 10-2003-0083596

(51) Int. Cl.
*H01J 1/62* (2006.01)
*H01J 17/49* (2006.01)

(52) U.S. Cl. ..... 313/582; 313/485; 313/486

(58) Field of Classification Search ..... 313/582–587, 313/485, 486

See application file for complete search history.

(56) References Cited

U.S. PATENT DOCUMENTS 5,674,553 A 10/1997 Shinoda et al.
6,420,835 B1 7/2002 Chen et al.
6,498,430 B1 12/2002 Sakai et al.
6,713,959 B1 * 3/2004 Toyoda et al. ..... 313/582
6,870,315 B2 3/2005 Igushi et al.
7,164,231 B2 * 1/2007 Choi et al. ..... 313/587
2002/0113552 A1 * 8/2002 Juestel et al. ..... 313/587
2002/0180354 A1 12/2002 Sano et al.
2004/0114248 A1 6/2004 Hokazono et al.
2005/0134166 A1 * 6/2005 Choi et al. ..... 313/485
2005/0258751 A1 11/2005 Kang et al.
2006/0197450 A1 * 9/2006 Kwon ..... 313/586
2007/0103078 A1 * 5/2007 Son et al. ..... 313/587

FOREIGN PATENT DOCUMENTS

CN 1216149 5/1999

(Continued)

OTHER PUBLICATIONS

European Patent Office Patent Abstracts of Japan for Publication No. 11096922, Publication Date Apr. 9, 1999.
Korean Patent Abstracts, Publication No. 1020020063395 A; Publication Date: Aug. 3, 2002; in the name of Jung.
Korean Patent Abstracts, Publication No. 1020030036017A; Publication Date: May 9, 2003; in the name of Masatoshi et al.

(Continued)

*Primary Examiner*—Peter Macchiarolo
(74) *Attorney, Agent, or Firm*—Christie, Parker & Hale, LLP

(57) ABSTRACT

A plasma display panel includes a red phosphor layer, a green phosphor layer, and a blue phosphor layer. The thickness of the phosphor layer is satisfied by the following condition: when D is (S−2L)/S, D≧0.64, S being a distance between barrier ribs at half the height of the barrier ribs, and L being a side thickness of the phosphor layer coated on the barrier ribs at half the height thereof.

27 Claims, 3 Drawing Sheets

FOREIGN PATENT DOCUMENTS

| | | | |
|---|---|---|---|
| CN | 1360328 | | 7/2002 |
| EP | 0 884 754 | A1 | 12/1998 |
| JP | 6-243789 | | 9/1994 |
| JP | 10-096922 | | 4/1998 |
| JP | 10-247458 | | 9/1998 |
| JP | 10-269949 | | 10/1998 |
| JP | 11-96922 | | 4/1999 |
| JP | 11-327498 | | 11/1999 |
| JP | 2000-208057 | | 7/2000 |
| JP | 2003-288846 | | 10/2003 |
| KR | 2002-0063395 | | 8/2002 |
| KR | 2003-0036017 | | 5/2003 |

OTHER PUBLICATIONS

Patent Abstract of Japan, Publication No. 10-269949, Published on Oct. 9, 1998, in the name of Aoto, et al.
Patent Abstracts of Japan, Publication No. 06-246789, dated Sep. 2, 1994, in the name of Motohiro Oka et al.
Patent Abstracts of Japan, Publication No. 10-247458, dated Sep. 14, 1998, in the name of Eiichiro Nonaka et al.
Patent Abstracts of Japan, Publication No. 11-327498, dated Nov. 26, 1999, in the name of Kazutaka Naka et al.
Patent Abstracts of Japan, Publication No. 2000-208057, dated Jul. 28, 2000, in the name of Masaaki Asano et al.
Patent Abstracts of Japan, Publication No. 2003-288846, dated Oct. 10. 2003, in the name of Takahiro Takamori et al.

* cited by examiner

PLASMA DISPLAY PANEL WITH DEFINED PHOSPHOR LAYER THICKNESSES

CROSS REFERENCE TO RELATED APPLICATION

This application is a continuation of U.S. patent application Ser. No. 10/996,581 filed on Nov. 22, 2004, now U.S. Pat. No. 7,164,231 which claims priority to and the benefit of Korean patent application No. 10-2003-0083596 filed in the Korean Intellectual Property Office on Nov. 24, 2003, the entire disclosure of which is incorporated herein by reference.

U.S. patent application Ser. No. 10/996,581 filed Nov. 22, 2004 discloses subject matter that may be considered related to this application.

BACKGROUND OF THE INVENTION (a) Field of the Invention

The present invention relates to a plasma display panel, and more particularly to a plasma display panel having good brightness and good color purity characteristics as well as a good optical characteristic in which discharge spots do not appear.

(b) Description of the Related Art

A plasma display panel (PDP) is a flat display device using a plasma phenomenon, which is also called a gas-discharge phenomenon since a discharge is generated in the panel when a potential greater than a certain level is applied to two electrodes separated from each other under a gas atmosphere in a non-vacuum state. Such gas-discharge phenomenon is applied to display an image in the plasma display panel.

FIG. 1 is a perspective view of plasma display panel 1. As shown in FIG. 1, a plurality of barrier ribs 7 are disposed between front substrate 3 and rear substrate 5 with a certain distance therebetween to form a discharge cell. In the cell space, red, green, and blue phosphors 9 are formed. On rear substrate 5, address electrodes 11 to be applied with the address signal are formed. On front substrate 3, a pair of sustain electrodes (electrode X 13, electrode Y 15) is formed in one discharge cell in a perpendicular direction to that of the address electrodes. To the discharge space, a discharge gas such as Ne—Xe or He—Xe is injected. That is, three electrodes are mounted in the discharge space of the plasma display panel, which is coated with the red, the green, and the blue phosphors in a regular pattern. When a certain level of voltage is applied between these electrodes, plasma discharge occurs to generate ultraviolet rays, and thereby the phosphors are excited to emit light.

Phosphor layer 9 is prepared by coating a phosphor paste on the surface of a discharge cell surrounded by front substrate 3, rear substrate 5, and barrier rib 7. The phosphor paste is prepared by adding the phosphor to a binder and a solvent. When the side thickness of the phosphor contacting the barrier rib is too thick, a panel spot may occur in a slanting direction so that the brightness is decreased. However, attempts to control the side thickness of the phosphor layer in order to improve the optical characteristics of the plasma display panel have not yet been made.

SUMMARY OF THE INVENTION

In accordance with the present invention, a plasma display panel is provided having good brightness and color purity characteristics, as well as a good optical characteristic in which panel spots do not appear.

The present invention relates to a plasma display panel phosphor layer comprising a red phosphor layer, a green phosphor layer, and a blue phosphor layer, wherein the side thickness of the red phosphor layer coated on a barrier rib is satisfied by the following condition:

when $D$ is $(S-2L)/S$; $D \geqq 0.64$ wherein

D is a width of a discharge space;

S is a distance between barrier ribs at half the height of the barrier ribs; and L is a side thickness of the phosphor layer coated on the barrier ribs at half the height thereof.

DETAILED DESCRIPTION

In the plasma display panel, a color temperature of emitted white light is 8000 K or higher, and it is controlled to have the color coordinate of x=0.280-0.290 and y=0.280-0.290. In order to control the color temperature of the emitted white light within the desired range, the brightness ratio of the red, the green, and the blue needs to be controlled. In this case, the brightness of the red color and the green color are lowered to below the maximum brightness level. When the brightness is lowered to below the maximum level, the red and the green colors are expressed by 256 or less gray levels (in a case of 8 subfields). Accordingly, in a case when the color temperature of white light emission is controlled within the desired range, decreases of the red and the green brightness should be minimized.

Japanese Patent Laid-open Publication No. H10-269949 discloses that a deterioration of display quality can be prevented and a decrease of brightness can be minimized by adjusting the thickness of a red phosphor layer, a green phosphor layer, and a blue phosphor layer contacting the substrate as different levels for each of the phosphor layers. However, the brightness of the phosphor layer is not affected by this reduced thickness.

In accordance with the present invention, a plasma display panel is provided having good brightness and good color purity characteristics as well as a good optical characteristic in which panel spots do not appear, by adjusting the side thickness of the phosphor layer within a certain range. The side thickness determines a discharge space ratio value (D) of a discharge cell, and D satisfies the following condition:

$$D=(S-2L)/S.$$

Figure 1:
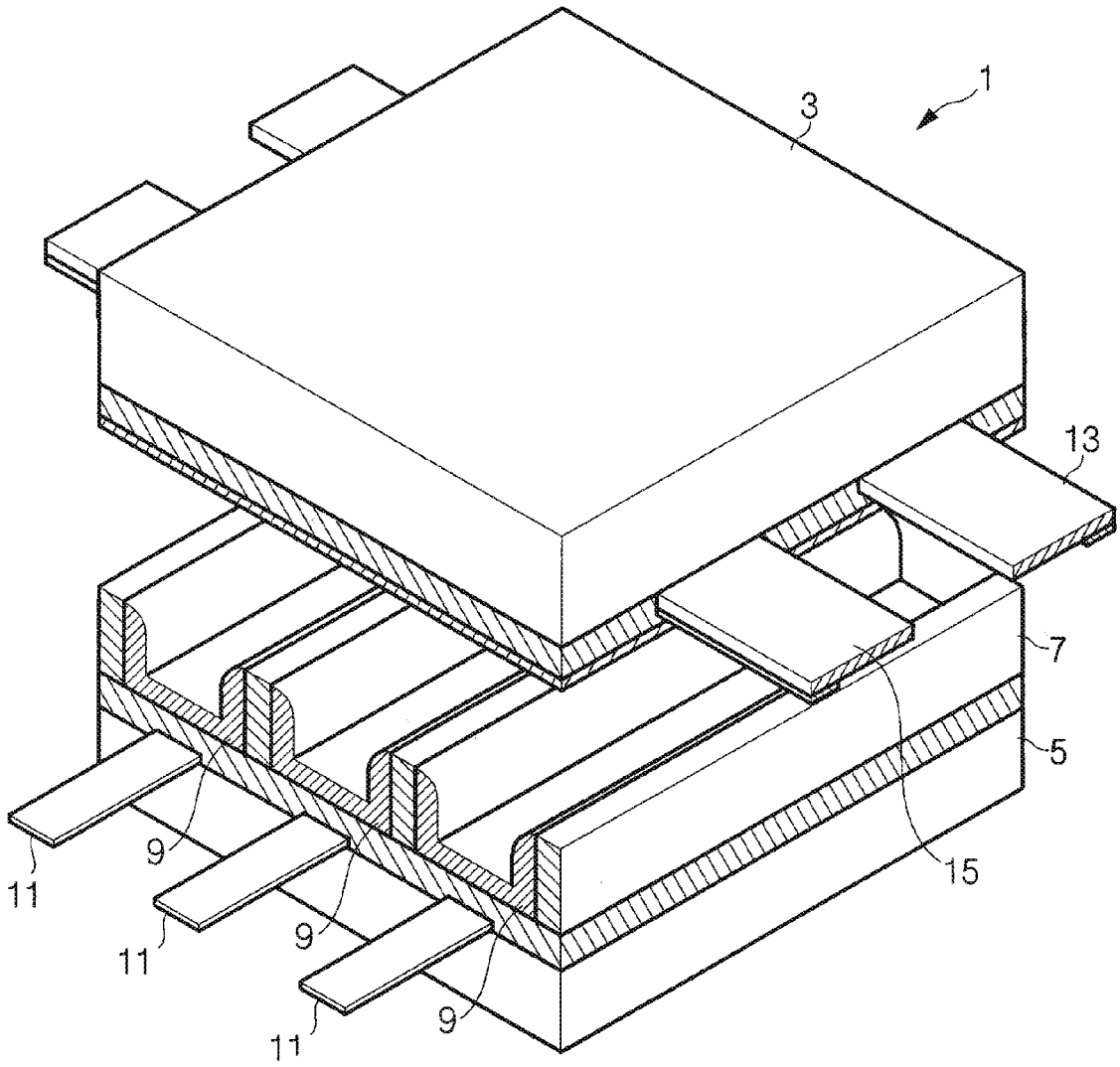
FIG. 1 is a perspective view showing the structure of a plasma display panel.
Figure 2:
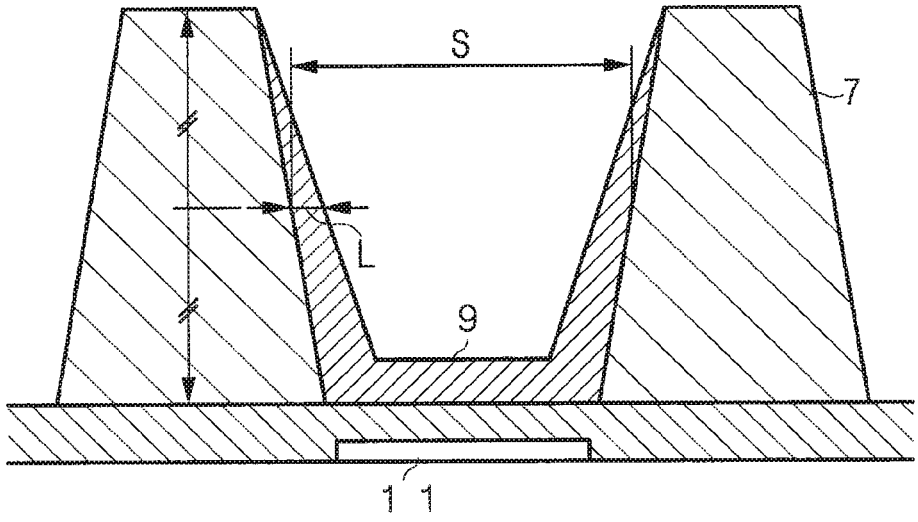
FIG. 2 is a cross-sectional view showing a phosphor layer of a plasma display panel.

D is defined as a function of width of discharge space. As shown in FIG. 2, S is a distance between barrier ribs at half the height of the barrier ribs and L is a side thickness of the phosphor layer coated on the barrier ribs at half the height thereof.

According to embodiments of the present invention, the optical and discharge characteristics can be improved by adjusting the side thickness of the phosphor layer to satisfy the condition $D \geqq 0.64$, and advantageously $0.73 \leqq D_r \leqq 0.89$. When D is less than 0.64, it is not advantageous since a discharge spot appears. It is advantageous that at least one of the side thicknesses of each phosphor layer is different from each other.

Further, when $D_r$, $D_g$, and $D_b$ respectively represent the D value of a red discharge cell, a green discharge cell, and a blue discharge cell which are respectively formed with a red phosphor layer, a green phosphor layer, and a blue phosphor layer, it is advantageous to satisfy the conditions $0.73 \leqq D_r \leqq 0.89$, $0.64 \leqq Dg \leqq 0.89$, and $0.76 \leqq D_b \leqq 0.89$; and more advantageous when $0.85 \leqq D_r \leqq 0.89$, $0.76 \leqq D_g \leqq 0.89$, and $0.76 \leqq D_b \leqq 0.84$.

Figure 3A:
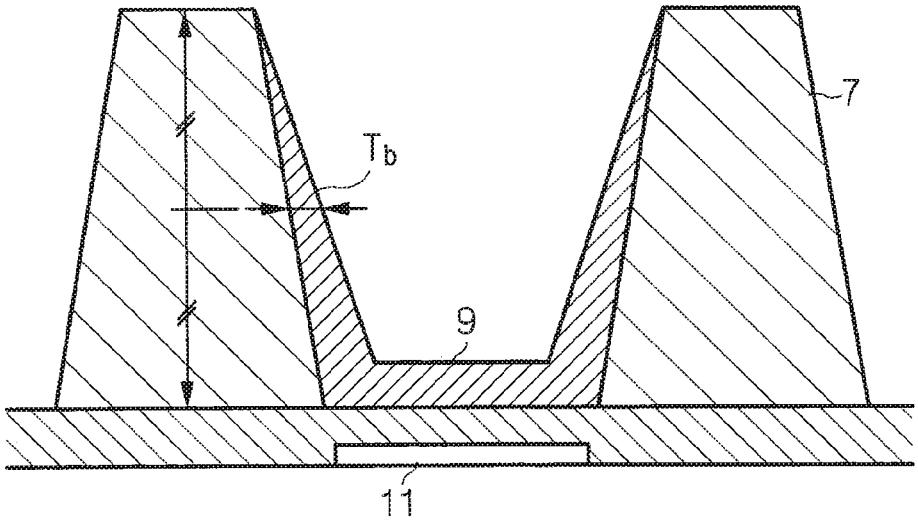
FIGS. 3A, 3B and 3C are cross-sectional views showing variations in side thickness of phosphor layers of plasma display panel.
Figure 3B:
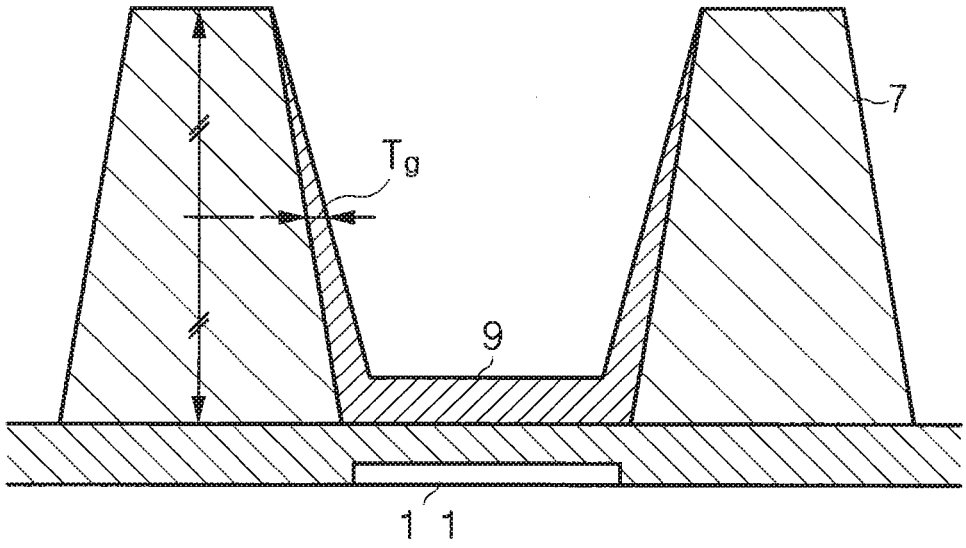
Figure 3C:
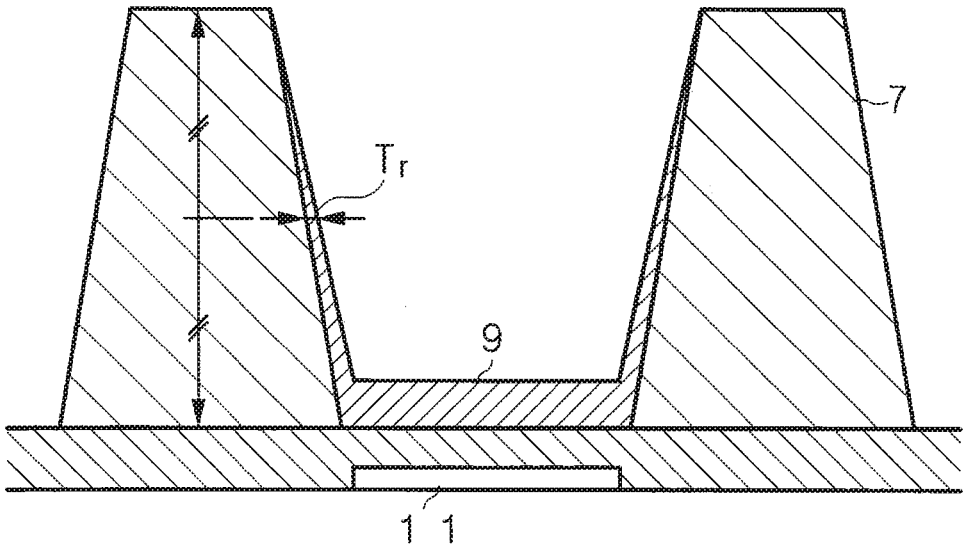

Further, referring to FIGS. 3A, 3B and 3C, when the side thicknesses T of a red phosphor layer, a green phosphor layer, and a blue phosphor layer are respectively represented by $T_r$, $T_g$, $T_b$, they are advantageously controlled to satisfy the condition $T_r < T_g \leqq T_b$. That is to say, it is advantageous that the side thickness of the red phosphor layer is smallest among the phosphor layers.

When $D_r$, $D_g$, and $D_b$ are respectively represented for the D value of a red discharge cell, a green discharge cell, and a blue discharge cell which are respectively formed with a red phosphor layer, a green phosphor layer, and a blue phosphor layer, they are satisfied by the condition $D_r > D_g \geqq D_b$ when the side thickness of each phosphor is controlled as above. It is advantageous that the ratio of $D_r/(D_g$ or $D_b)$ ranges 1.1 to 1.4, and more advantageously 1.17 to 1.37.

In accordance with the present invention, the side thicknesses of the phosphor layers are controlled within the above-mentioned conditions, and advantageously the side thicknesses of the phosphor layers are different from each other so the decrease of the red brightness is minimized when adjusting the color temperature of the panel such that the brightness and the color purity characteristics of the plasma display panel are optimized. Further, in order to determine the relationship of differences of human visual senses, the change of optical characteristics depending upon the side thickness of the phosphor layer is measured using the CIE 1976 (L*u*v*) color difference formula. The suitable thicknesses of phosphor layers and the deviation of thickness are determined using the color difference, and in the real field, the quality of the plasma display panel is improved by determining the thickness of each phosphor layer within the deviation range.

According to the CIE 1931 standard colorimetric system, 3 stimuli of X, Y, and Z are determined from the color matching function $\bar{x}(\lambda)$, $\bar{y}(\lambda)$, $\bar{z}(\lambda)$ (wherein the bar above each of x, y, and z indicates the mean value thereof). The color coordinates of x and y can be determined from the 3 stimuli X, Y, and Z, and the color coordinates can be measured by CA-100. However, the demerit of the CIE 1931 standard colorimetric system is that the color difference determined from the xy diagram is intellectually not uniform. Accordingly, the CIE 1976 uniform chromaticity scale diagram or the CIE 1976 UCS diagram has recently been accepted, since an identical color difference with respect to the same color is measured from an equal distance on the diagram. Accordingly, the color difference is determined by the following CIE 1976 (L*u*v) color difference equation:

$$\Delta E^*_{uv}=\{(\Delta L^*)^2+(\Delta u^*)^2+(\Delta v^*)^2\}^{1/2}$$

$$L^*=116(Y/Y_n)^{1/3}-16,\ (Y/Y_n>0.008856)$$

$$L^*=903.3(Y/Y_n)^{1/13},\ (Y/Y_n \leqq 0.008856)$$

$$u^*=13L^*(u'-u_n')$$

$$v^*=13L^*(v'-v_n')$$

$$u_n'=0.2009,\ v_n'=0.5444,$$

wherein Y is a brightness measured by CA-100.

The inert discharge gas injected to the discharge space of the plasma display panel may include Ne, He, Xe, Kr, and so on, and it may be added with an additional gas such as oxygen, nitrogen, and so on. Among them, the neon emitting an orange-red based light causes problems in that the color purity of the plasma display panel is deteriorated. According to the present invention, when the side thickness of the phosphor layer is controlled to satisfy the condition of $D \geqq 0.64$, the intensity of orange-red based light can be decreased.

The green phosphor of the present invention may be selected from the group consisting of $(Y,Gd)BO_3$:Eu, Y(V,P)04:Eu, $(Y,Gd)O_3$:Eu, and mixtures thereof. It is advantageous that $(Y,Gd)BO_3$:Eu having good brightness properties is used, and thereby the red brightness is minimized when adjusting the color temperature of the panel so that the brightness and the color purity characteristics of the plasma display panel are optimized.

The green phosphor of the present invention may be selected from the group consisting of $Zn_2SiO_4$:Mn, $(Zn,A)_2SiO_4$:Mn where A is an alkaline metal, and mixtures thereof. It may be further mixed with at least one phosphor selected from the group consisting of $BaAl_{12}O_{19}$:Mn, (Ba, Sr, Mg)O·$\alpha A_2O_3$:Mn where $\alpha$ is from 1 to 23, $MgAl_xO_y$:Mn where x is from 1 to 10 and y is from 1 to 30, $LaMgAl_xO_y$:Tb,Mn where x is from 1 to 14 and y is from 8 to 47, and $ReBO_3$:Tb where Re is at least one rare earth element selected from the group consisting of Sc, Y, La, Ce, and Gd. In the case of mixing them, it advantageously comprises 10 to 70% by weight of a green phosphor selected from the group consisting of $Zn_2SiO_4$:Mn, $(Zn,A)_2SiO_4$:Mn where A is an alkaline metal, and mixtures thereof.

The blue phosphor of the present invention may include, but is not limited to, $BaMgAl_{10}O_{17}$:Eu, $CaMgSi_2O_6$:Eu, $CaWO_4$:Pb, Y2$SiO_5$:Eu, or mixtures thereof.

The red, green, and blue phosphors are respectively added to a binder and a solvent to provide a phosphor paste, and the resultant phosphor paste is coated on the surface of the discharge cell to provide a phosphor layer.

The binder may include, but is not limited to, a cellulose-based resin, an acryl-based resin, or a mixture thereof. The cellulose-based resin may be methyl cellulose, ethyl cellulose, propyl cellulose, hydroxy methyl cellulose, hydroxy ethyl cellulose, hydroxy propyl cellulose, hydroxy ethyl propyl cellulose, or a mixture thereof. The acryl-based resin may be a copolymer of an acrylic monomer such as poly methyl methacrylate, poly isopropyl methacrylate, poly isobutyl methacrylate, methyl methacrylate, ethyl methacrylate, propyl methacrylate, butyl methacrylate, hexyl methacrylate, 2-ethyl hexyl methacrylate, benzyl methacrylate, dimethyl amino ethyl methacrylate, hydroxy ethyl methacrylate, hydroxy propyl methacrylate, hydroxy butyl methacrylate, phenoxy 2-hydroxy propyl methacrylate, glycidyl methacrylate, methyl acrylate, ethyl acrylate, propyl acrylate, butyl acrylate, hexyl acrylate, 2-ethyl hexyl acrylate, benzyl acrylate, dimethyl amino ethyl acrylate, hydroxy ethyl acrylate, hydroxy propyl acrylate, hydroxy butyl acrylate, phenoxy 2-hydroxy propyl acrylate, glycidyl acrylate, or a mixture thereof. If desired, a small amount of inorganic binder may be added to the phosphor paste composition. The amount of the binder is advantageously about 2% to about 8% by weight relative to the phosphor paste composition.

The solvent may include any conventional one for the phosphor paste composition such as alcohol-based, ether-based, or ester-based solvents, or a mixture thereof, and more advantageously butyl carbitol (BC), butyl carbitol acetate (BCA), terpineol, or a mixture thereof. When the amount of the solvent is outside the above-mentioned range, the rheology is inappropriate so that it is hard to apply the phosphor layer. Considering this point, the amount of the solvent is advantageously between about 25 and about 75% by weight.

Other agents may be further added thereto to improve the rheology and the processability of the composition. The agents may include, but are not limited to, a photosensitizer such as benzophenone, a dispersing agent, a silicon-based antifoaming agent, a smoothing agent, a plasticizer, an antioxidant, or a mixture thereof, which are commercially available to one skilled in the art.

As the various manufacturing methods and structures of the phosphor layer for the plasma display panel are known to one having ordinary skill in the art, a detailed description relating thereto is omitted herein.

The following examples illustrate the present invention in further detail. However, it is understood that the present invention is not limited by these examples.

EXAMPLE 1

Red Phosphor Layer $(Y,Gd)BO_3$:Eu red phosphor was added to a binder solution in which 5.6 wt % of ethyl cellulose as a binder was dissolved in a mixed solvent of carbitol acetate and terpineol in a volume ratio of 3:7 to obtain a phosphor paste composition. The amount of the phosphor was varied to 30 wt. %, 40 wt. %, 47 wt. %, and 52 wt. %, and the phosphor paste composition was printed on the surface of a discharge cell and sintered to form a phosphor layer to provide a plasma display panel by the conventional method. Then, only the red phosphor layer was lit up, and the CIE color coordinate and the relative brightness of the red color light emitted from the plasma display panel were measured using a contact brightness meter (CA-100). The color difference was 10 calculated using the color difference formula represented by Formula 1. The display quality was determined by examining with the naked eye whether spots appeared because of the local brightness difference upon turning on the panel.

TABLE 1

| Amount of Red Phosphor (wt. %) | Side Thickness (μm) | $D_r$ | Color Coordinate x | Color Coordinate y | Relative Brightness (%) | UCS, Color Difference | Display Quality* |
|---|---|---|---|---|---|---|---|
| 30 | 11.7 | 0.89 | 0.649 | 0.342 | 100 | 0 | □ |
| 40 | 17.3 | 0.85 | 0.650 | 0.342 | 112.3 | 19.8 | □ |
| 47 | 25 | 0.77 | 0.650 | 0.342 | 112.6 | 20.2 | □ |
| 52 | 29.7 | 0.73 | 0.649 | 0.342 | 108.9 | 14.8 | □ |

*Display Quality: □: Excellent, ○: Good, X: Discharge spot appeared

As shown in Table 1, when the thickness of the red phosphor layer was adjusted for Dr within the range of 0.73 to 0.89, the discharge spot did not appear, indicating that the display quality was improved. The color coordinate changes were negligible in accordance with the thickness. However, the smaller the thickness, i.e., the larger the Dr, the less brightness characteristics were decreased when controlling the color temperature of the panel.

EXAMPLE 2

Green Phosphor Layer

Green phosphor of $Zn_2SiO_4$:Mn was added to a binder solution in which 5.6 wt % of ethyl cellulose as a binder was dissolved in a mixed solvent of carbitol acetate and terpineol in a volume ratio of 3:7 to obtain a phosphor paste composition. The amount of the phosphor was varied to 30 wt. %, 40 wt. %, 50 wt. %, and 55 wt. %, and the phosphor paste composition was printed on the surface of the discharge cell and sintered to form a phosphor layer. Using the phosphor layer, a plasma display panel was obtained by the conventional method. Then, only the green phosphor layer was lit up, and the CIE color coordinate and the relative brightness of the green color light emitted from the plasma display panel were measured using the contact brightness meter (CA-100). The color difference was calculated using the color difference formula represented by Formula 1. The display quality was determined by examining with the naked eye whether spots appeared because of the local brightness difference upon turning on the panel.

TABLE 2

| Amount of Green Phosphor (wt. %) | Side Thickness (μm) | $D_g$ | Color Coordinate x | Color Coordinate y | Relative Brightness (%) | UCS, Color Difference | Display Quality* |
|---|---|---|---|---|---|---|---|
| 30 | 14.6 | 0.89 | 0.259 | 0.678 | 100 | 10.8 | □ |
| 40 | 25.4 | 0.81 | 0.253 | 0.683 | 104.3 | 0 | □ |
| 50 | 41 | 0.69 | 0.261 | 0.674 | 106.5 | 8 | ○ |
| 55 | 49.2 | 0.63 | 0.266 | 0.670 | 105.6 | 14.3 | X |

*Display Quality: □: Excellent, ○: Good, X: Discharge spot appeared

As shown in Table 2, when the thickness of the green phosphor layer was adjusted for Dg within the range of 0.69 to 0.89, a discharge spot did not appear and the display quality was improved. When the side thickness of the green phosphor layer was more than 40 μm, although the color purity was decreased and the brightness was improved, the color purity and the brightness were both controlled to an optimal level when Dg was 0.81.

EXAMPLE 3

Blue Phosphor Layer

Blue phosphor of $BaMgAl_{10}O_{17}$:Eu was added to a binder solution in which 5.6 wt % of ethyl cellulose as a binder was dissolved in a mixed solvent of carbitol acetate and terpineol in a volume ratio of 3:7 to obtain a phosphor paste composition. The amount of the phosphor was varied to 30 wt. %, 40 wt. %, 50 wt. %, and 65 wt. %, and the phosphor paste composition was printed on the surface of the discharge cell and sintered to form a phosphor layer. Using the phosphor layer, a plasma display panel was obtained by the conventional method. Then, only the blue phosphor layer was lit up, and the CIE color coordinate and the relative brightness of the blue color light emitted from the plasma display panel were measured using the contact brightness meter (CA-100). The color difference was calculated using the color difference formula represented by Formula 1. The display quality was determined by examining with the naked eye whether spots appeared because of the local brightness difference upon turning on the panel.

TABLE 3

| Amount of Blue Phosphor (wt %) | Side Thickness (μm) | $D_b$ | Color Coordinate x | Color Coordinate y | Relative Brightness (%) | UCS, Color Difference | Display Quality* |
|---|---|---|---|---|---|---|---|
| 30 | 23.6 | 0.84 | 0.156 | 0.096 | 100 | 5.1 | □ |
| 40 | 35.8 | 0.76 | 0.155 | 0.097 | 103.5 | 0 | □ |
| 50 | 54.4 | 0.64 | 0.157 | 0.099 | 95 | 20.4 | ○ |
| 55 | 67.6 | 0.56 | 0.160 | 0.100 | 93.1 | 27.5 | X |

*Display Quality: □: Excellent, ○: Good, X: Discharge spot appeared

As shown in Table 3, when the thickness of the green phosphor layer was adjusted for Db within the range of 0.64 to 0.89, a discharge spot did not appear and the display quality was improved. When the side thickness of the green phosphor layer was more than 40 μm, although the color purity and the brightness were decreased, the color purity and the brightness were both controlled to an optimal level when Db was 0.76.

As described in the above, the plasma display panel of the present invention can prevent generation of a discharge spot and improve the brightness and color purity by adjusting the side thickness of the phosphor coated on the barrier rib within the above range.

While the present invention has been described in detail with reference to exemplary embodiments, those skilled in the art will appreciate that various modifications and substitutions can be made thereto without departing from the spirit and scope of the present invention as set forth in the appended claims.

What is claimed is:

1. A plasma display panel comprising:

a red phosphor layer, a green phosphor layer, and a blue phosphor layer, wherein a side thickness of a phosphor layer coated on barrier ribs is satisfied by the following condition: $D \geqq 0.64$, wherein D is a discharge space ratio value defined by $(S-2L)/S$;

wherein S is a distance between barrier ribs at half a height of the barrier ribs; and wherein L is the side thickness of the phosphor layer coated on the barrier ribs at half the height of the barrier ribs; and wherein the barrier ribs include a top and a bottom and a thickness which increases from the top to the bottom.

2. The plasma display panel according to claim 1, wherein the side thickness of the phosphor layer coated on the barrier ribs is satisfied by the following condition: $0.73 \leqq D \leqq 0.89$.

3. The plasma display panel according to claim 1, wherein at least one of a side thickness of the red phosphor layer, the green phosphor layer or the blue phosphor layer at half the height of the barrier ribs is different from another of the side thickness of the red phosphor layer, the green phosphor layer or the blue phosphor layer.

4. The plasma display panel according to claim 3, which is satisfied by the conditions of $0.73 \leqq D_r \leqq 0.89$, $0.64 \leqq D_g \leqq 0.89$, and $0.76 \leqq D_b \leqq 0.89$, wherein $D_r$, $D_g$, and $D_b$ respectively represent discharge space ratio values D of a red discharge cell, a green discharge cell, and a blue discharge cell that are respectively formed with the red phosphor layer, the green phosphor layer, and the blue phosphor layer.

5. The plasma display panel according to claim 1, which is satisfied by the condition of $T_r<T_g\leqq T_b$, wherein $T_r$, $T_g$, and $T_b$ respectively represent the side thickness T of the red phosphor layer, the green phosphor layer, and the blue phosphor layer.

6. The plasma display panel according to claim 1, which is satisfied by the conditions of $D_r>D_g\geqq D_b$, wherein $D_r$, $D_g$, and $D_b$ respectively represent discharge space ratio values D of a red discharge cell, a green discharge cell, and a blue discharge cell that are respectively formed with the red phosphor layer, the green phosphor layer, and the blue phosphor layer.

7. The plasma display panel according to claim 6, wherein a $D_r/(D_g$ or $D_b)$ ratio, where $D_r$, $D_g$, and $D_b$ respectively represent discharge space ratio values D of a red discharge cell, a green discharge cell, and a blue discharge cell that are respectively formed with the red phosphor layer, the green phosphor layer, and the blue phosphor layer, is within the range of 1.1 to 1.4.

8. A plasma display panel comprising:

a red phosphor layer, a green phosphor layer, and a blue phosphor layer, wherein a side thickness of a phosphor layer coated on barrier ribs is satisfied by the following condition: $D\geqq 0.64$, wherein D is a discharge space ratio value defined by (S−2L)/S;

wherein S is a distance between barrier ribs at half the height of the barrier ribs; and wherein L is the side thickness of the phosphor layer coated on the barrier ribs at half a height of the barrier ribs;

wherein the barrier ribs include a top and a bottom and a thickness of the barrier rib increases from the top to the bottom; and wherein at least one of the red phosphor layer, the green phosphor layer or the blue phosphor layer has a side thickness at the top of the barrier ribs that is less than the side thickness at half the height of the barrier ribs.

9. The plasma display panel according to claim 8, wherein the side thickness of the phosphor layer coated on the barrier ribs is satisfied by the following condition: $0.73\leqq D\leqq 0.89$.

10. The plasma display panel according to claim 8, wherein at least one of a side thickness of the red phosphor layer, the green phosphor layer or the blue phosphor layer at half the height of the barrier ribs is different from another of the side thickness of the red phosphor layer, the green phosphor layer or the blue phosphor layer.

11. The plasma display panel according to claim 10, which is satisfied by the conditions of $0.73\leqq D_r\leqq 0.89$, $0.64\leqq D_g\leqq 0.89$, and $0.76\leqq D_b\leqq 0.89$, wherein $D_r$, $D_g$, and $D_b$ respectively represent discharge space ratio values D of a red discharge cell, a green discharge cell, and a blue discharge cell that are respectively formed with the red phosphor layer, the green phosphor layer, and the blue phosphor layer.

12. The plasma display panel according to claim 8, which is satisfied by the conditions of $T_r<T_g\leqq T_b$, wherein $T_r$, $T_g$, and $T_b$ respectively represent the side thickness T of the red phosphor layer, the green phosphor layer, and the blue phosphor layer.

13. The plasma display panel according to claim 8, which is satisfied by the conditions of $D_r>D_g\geqq D_b$, wherein $D_r$, $D_g$, and $D_b$ respectively represent discharge space ratio values D of a red discharge cell, a green discharge cell, and a blue discharge cell that are respectively formed with the red phosphor layer, the green phosphor layer, and the blue phosphor layer.

14. The plasma display panel according to claim 13, wherein a $D_r/(D_g$ or $D_b)$ ratio, where $D_r$, $D_g$, and $D_b$ respectively represent discharge space ratio values D of a red discharge cell, a green discharge cell, and a blue discharge cell that are respectively formed with the red phosphor layer, the green phosphor layer, and the blue phosphor layer, is within the range of 1.1 to 1.4.

15. A plasma display panel comprising:

a red phosphor layer, a green phosphor layer, and a blue phosphor layer, wherein a side thickness of a phosphor layer coated on barrier ribs is satisfied by the following condition: $D\geqq 0.64$, wherein D is a discharge space ratio value defined by (S−2L)/S;

wherein S is a distance between barrier ribs at half a height of the barrier ribs; and wherein L is the side thickness of the phosphor layer coated on the barrier ribs at half the height of the barrier ribs, which is satisfied by the conditions of $D_r>D_g\geqq D_b$, when $D_r$, $D_g$, and $D_b$ respectively represent discharge space ratio values D of a red discharge cell, a green discharge cell, and a blue discharge cell that are respectively formed with the red phosphor layer, the green phosphor layer, and the blue phosphor layer.

16. The plasma display panel according to claim 15, wherein the side thickness of a phosphor layer coated on the barrier ribs is satisfied by the following condition: $0.73\leqq D\leqq 0.89$.

17. The plasma display panel according to claim 15, wherein at least one of a side thickness of the red phosphor layer, the green phosphor layer or the blue phosphor layer at half the height of the barrier ribs is different from another of the side thickness of the red phosphor layer, the green phosphor layer or the blue phosphor layer.

18. The plasma display panel according to claim 17, which is satisfied by the conditions of $0.73\leqq D_r\leqq 0.89$, $0.64\leqq D_g\leqq 0.89$, and $0.76\leqq D_b\leqq 0.89$, wherein $D_r$, $D_g$, and $D_b$ respectively represent discharge space ratio values D of a red discharge cell, a green discharge cell, and a blue discharge cell that are respectively formed with the red phosphor layer, the green phosphor layer, and the blue phosphor layer.

19. The plasma display panel according to claim 15, which is satisfied by the conditions of $T_r<T_g\leqq T_b$, wherein $T_r$, $T_g$, and $T_b$ respectively represent the side thickness T of the red phosphor layer, the green phosphor layer, and the blue phosphor layer.

20. The plasma display panel according to claim 16, which is satisfied by the conditions of $D_r>D_g\geqq D_b$, wherein $D_r$, $D_g$, and $D_b$ respectively represent discharge space ratio values D of a red discharge cell, a green discharge cell, and a blue discharge cell that are respectively formed with the red phosphor layer, the green phosphor layer, and the blue phosphor layer.

21. The plasma display panel according to claim 20, wherein a $D_r/(D_g$ or $D_b)$ ratio, wherein $D_r$, $D_g$, and $D_b$ respectively represent discharge space ratio values D of a red discharge cell, a green discharge cell, and a blue discharge cell that are respectively formed with the red phosphor layer, the green phosphor layer, and the blue phosphor layer, is within the range of 1.1 to 1.4.

22. A method of forming a red phosphor layer for a plasma display panel, the method comprising:

forming a barrier rib to obtain a discharge cell;

obtaining a red phosphor composition having 30 to 52 wt % of red phosphor;

printing the red phosphor composition on a surface of the discharge cell; and sintering the plasma display panel to obtain the red phosphor layer, wherein a side thickness of the red phosphor layer coated on the barrier rib is satisfied by the following condition: $D \geqq 0.64$, wherein D is a discharge space ratio value defined by $(S-2L)/S$;

wherein S is a distance between barrier ribs at half a height of the barrier ribs; and wherein L is the side thickness of the red phosphor layer coated on the barrier ribs at half the height of the barrier ribs.

23. The method of claim 22, wherein the thickness of a phosphor layer coated on the barrier ribs is satisfied by the following condition: $0.73 \leqq D \leqq 0.89$.

24. A method of forming a green phosphor layer for a plasma display panel, comprising:

forming a barrier rib to obtain a discharge cell;

obtaining a green phosphor composition having 30 to 50 wt % of green phosphor;

printing the green phosphor composition on a surface of the discharge cell; and sintering the plasma display panel to obtain the green phosphor layer, wherein a side thickness of the green phosphor layer coated on the barrier rib is satisfied by the following condition: $D \geqq 0.64$, wherein D is a discharge space ratio value defined by $(S-2L)/S$;

wherein S is a distance between barrier ribs at half a height of the barrier ribs; and wherein L is the side thickness of the green phosphor layer coated on the barrier ribs at half the height of the barrier ribs.

25. The method of claim 24, wherein the thickness of the green phosphor layer coated on the carrier barrier ribs is satisfied by the following condition: $0.69 \leqq D \leqq 0.89$.

26. A method of forming a blue phosphor layer for a plasma display panel, comprising:

forming a barrier rib to obtain a discharge cell;

obtaining a blue phosphor composition having 30 to 50 wt % of blue phosphor;

printing the blue phosphor composition on a surface of the discharge cell; and sintering the plasma display panel to obtain the blue phosphor layer, wherein a side thickness of the blue phosphor layer coated on the barrier rib is satisfied by the following condition: $D \geqq 0.64$, wherein D is a discharge space ratio value defined by $(S-2L)/S$;

wherein S is a distance between barrier ribs at half a height of the barrier ribs; and wherein L is a side thickness of the blue phosphor layer coated on the barrier ribs at half the height of the barrier ribs.

27. The method of claim 24, wherein the side thickness of the blue phosphor layer coated on the barrier ribs is satisfied by the following condition: $0.64 \leqq D \leqq 0.84$.

* * * * *

UNITED STATES PATENT AND TRADEMARK OFFICE

CERTIFICATE OF CORRECTION

PATENT NO. : 7,495,395 B2
APPLICATION NO. : 11/607470
DATED : February 24, 2009
INVENTOR(S) : Seo-Young Choi et al.

It is certified that error appears in the above-identified patent and that said Letters Patent is hereby corrected as shown below:

On the Title Page

None

In the Claims

Column 10, Claim 20, line 51 Delete "16" Insert -- 15 --

Signed and Sealed this
Thirty-first Day of May, 2011

David J. Kappos

David J. Kappos
*Director of the United States Patent and Trademark Office*